US007863537B2

(12) United States Patent
Shea et al.

(10) Patent No.: US 7,863,537 B2
(45) Date of Patent: Jan. 4, 2011

(54) GASSING INSULATOR ASSEMBLY, AND CONDUCTOR ASSEMBLY AND ELECTRICAL SWITCHING APPARATUS EMPLOYING THE SAME

(75) Inventors: John J. Shea, Pittsburgh, PA (US); Nathan J. Weister, Darlington, PA (US); William C. Pollitt, Murrysville, PA (US); David M. Olszewski, Coraopolis, PA (US); James R. Schachner, Coraopolis, PA (US); Ronald W. Brand, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 557 days.

(21) Appl. No.: 11/869,172

(22) Filed: Oct. 9, 2007

(65) Prior Publication Data

US 2009/0090698 A1 Apr. 9, 2009

(51) Int. Cl.
*H01H 33/04* (2006.01)

(52) U.S. Cl. ..... 218/147; 218/37; 218/149; 335/201

(58) Field of Classification Search ..... 218/14–21, 218/30, 34–41, 46, 76, 78, 146–156; 335/201–204
See application file for complete search history.

(56) References Cited

U.S. PATENT DOCUMENTS

| | | | | |
|---|---|---|---|---|
| 5,475,193 | A * | 12/1995 | Perdoncin | 218/34 |
| 6,297,465 | B1 | 10/2001 | Groves et al. | |
| 6,703,576 | B1 | 3/2004 | Chou et al. | |
| 7,034,242 | B1 | 4/2006 | Shea et al. | |

* cited by examiner

*Primary Examiner*—Renee Luebke
*Assistant Examiner*—Marina Fishman
(74) *Attorney, Agent, or Firm*—Martin J. Moran

(57) ABSTRACT

A gassing insulator assembly for a line conductor assembly of an electrical switching apparatus is provided having a line conductor and first and second gassing insulator members. The insulator members are constructed from a gassing material. The first gassing insulator member is disposed near a first end of the line conductor and the second gassing insulator member is generally disposed between the line conductor and a cantilevered arc runner near a second end of the line conductor.

6 Claims, 6 Drawing Sheets

GASSING INSULATOR ASSEMBLY, AND CONDUCTOR ASSEMBLY AND ELECTRICAL SWITCHING APPARATUS EMPLOYING THE SAME

BACKGROUND OF THE INVENTION

1. Field of the Invention

The invention relates generally to electrical switching apparatus and, more particularly, to a gassing insulator assembly for the line conductor assembly of electrical switching apparatus, such as circuit breakers. The invention also relates to line conductor assemblies for electrical switching apparatus.

2. Background Information

Electrical switching apparatus, such as circuit breakers, for example, provide protection for electrical systems from electrical fault conditions such as, for example, current overloads, short circuits, abnormal voltage and other fault conditions.

Circuit breakers, for example, typically include a set of stationary electrical contacts and a set of movable electrical contacts. The stationary and movable electrical contacts are in physical and electrical contact with one another when it is desired that the circuit breaker energize a power circuit. When it is desired to interrupt the power circuit, the movable contacts and stationary contacts are separated. Upon initial separation of the movable contacts away from the stationary contacts, an electrical arc is formed in the space between the contacts. The arc is undesirable for a number of reasons. Among them is the fact that the arc results in the undesirable flow of electrical current through the circuit breaker to the load. Additionally, the arc, which extends between the contacts, often results in vaporization or sublimation of the contact material itself. Therefore, it is desirable to remove and extinguish any such arcs from the contacts as soon as possible upon their propagation.

To facilitate arc extinguishing, circuit breakers typically include arc chute assemblies adjacent to the opening path of the separable contacts. The arc chute is constructed of a number of spaced plates extending transverse to the arc. As the movable contact is moved away from the stationary contact, the movable contact moves past the ends of the arc plates, with the arc being magnetically drawn toward and between the arc plates. The arc plates are electrically insulated from one another such that the arc is broken-up and extinguished by the arc plates. Examples of arc chutes are disclosed in U.S. Pat. Nos. 7,034,242; 6,703,576; and 6,297,465.

To facilitate arc removal from the separable contacts, an elongate arc runner is typically mounted with one end in close proximity to the stationary contact and an opposite end in close proximity to the arc chute assembly in order to provide a surface for the arc to run away from the contacts and toward the arc chute. This protects the contacts from damage due to arcing. The arc is formed on the stationary contact and must travel across a joint to the arc runner. At relatively low currents, the electromagnetic force on the arc may not be adequate to force the arc to cross this joint. One end of the arc may remain on the stationary contact, severely eroding that contact.

Also, when the arc is created on the stationary contact, it is more likely to travel along a sharp edge or corner of the part. Arc runners often have a slot up the center of the part to provide an attractive edge for the arc to run along. The edge of the slot encourages the arc to travel up the center of the arc runner, engaging the arc chute near the center thereof and extinguishing the arc relatively sooner. However, use of such slots can weaken the arc runner and lead to failure. Additionally, at lower current levels, the arc may be attracted to the laterally extending edge of the stationary contact instead of the slot in the arc runner. This may prevent the arc from running up the arc runner or cause the arc to run to one side of the pole where it may track along the inside wall of the arc chamber.

There is a need therefore for electrical switching apparatus with an improved arrangement for extinguishing arcs generated during current interruption.

There is a more specific need for such an improved arrangement for directing the arc from the stationary contact into the arc chute.

There is also a need for an improved arrangement for keeping an arc away from the edges of the arc runner while passing from the stationary contact to the arc chute.

SUMMARY OF THE INVENTION

These needs and other are met by the embodiments of the invention, which provide a modular, gassing insulator assembly for a line conductor assembly which, in the presence of an electrical arc, provides outgassing in a manner which promotes arc extinguishing by promoting movement of the arc from the stationary contact toward an arc chute.

In accordance with one aspect of the invention, an insulator assembly is provided for a line conductor assembly of an electrical switching apparatus. The line conductor assembly includes a line conductor having a first end, a second end and a raised portion therebetween. A cantilever member is rigidly coupled to the raised portion and extends over a portion of the line conductor toward the second end of the line conductor. A stationary contact is rigidly coupled to the raised portion and is electrically connected to the cantilever member. The insulator assembly comprises a first insulator member structured to be generally disposed near the first end of the line conductor and a second insulator member structured to be generally disposed between the line conductor and the cantilever member near the second end of the line conductor.

The first insulator member may include a number of arm members structured to extend generally along a portion of the raised portion toward the second insulator member and terminating in a number of interlock structures. The second insulator member also may include a number of interlock structures which may fasteningly engage the number of interlock structures of the first insulating member.

The second insulator member may include a raised portion structured to extend generally around a periphery of the cantilever member.

The first insulating member may comprise an elongated retention member having a first end, a second end, and a central portion therebetween; and a number of retention openings structured to align with a retention structure extending from the first end of the line conductor. The first and second ends of the elongated retention member may engage the first insulating member at the retention openings and the central portion of the retention member may be structured to engage the retention structure of the line conductor.

The first insulator member may further be formed from a gassing insulator material structured in a manner to promote movement of an electrical arc formed near the stationary contact generally away from the stationary contact in a direction generally toward the cantilever member and the second insulator member may also be formed from a gassing insulator material structured in a manner to provide cooling to the cantilever member and to promote arc movement away from a periphery of the cantilever member.

Another aspect of the invention is directed to a line conductor assembly for an electrical switching apparatus having a housing. Housed within the housing is an arc chute assembly and a load conductor electrically connected to a movable contact assembly. The line conductor assembly comprises a line conductor including a first end, a second end and a raised portion therebetween. A stationary contact is rigidly coupled to the raised portion of the line conductor. The stationary contact is structured to be selectively electrically connected to the movable contact assembly. A cantilever member having a first end and a second end is electrically connected to the stationary contact and rigidly coupled by the first end to the raised portion of the line conductor. The cantilever member extends over a portion of the line conductor toward the second end of the line conductor and terminates at the second end of the cantilever member. The second end of the cantilever member is structured to be positioned in close proximity to the arc chute assembly. Also housed within the housing is an insulator assembly which comprises a first insulator member generally disposed near the first end of the line conductor and a second insulator member generally disposed between the line conductor and the cantilever member near the second end of the line conductor.

A further aspect of the invention is directed to an electrical switching apparatus comprising a housing, a load conductor, a movable contact assembly, an arc chute assembly, and a line conductor assembly. The line conductor assembly comprises a line conductor including a first end, a second end and a raised portion therebetween, a stationary contact rigidly coupled to the raised portion of the line conductor, a cantilever member including a first end electrically connected to the stationary contact and rigidly coupled to the raised portion of the line conductor, and an insulator assembly. The cantilever member extends over a portion of the line conductor toward the second end of the line conductor and terminates at a second end. The insulator assembly comprises a first insulator member generally disposed near the first end of the line conductor and a second insulator member generally disposed between the line conductor and the cantilever member near the second end of the line conductor. The movable contact assembly is electrically connected to the load conductor and selectively electrically connected to the stationary contact of the line conductor assembly. The arc chute assembly is positioned in close proximity to the second end of the cantilever member of the line conductor assembly.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
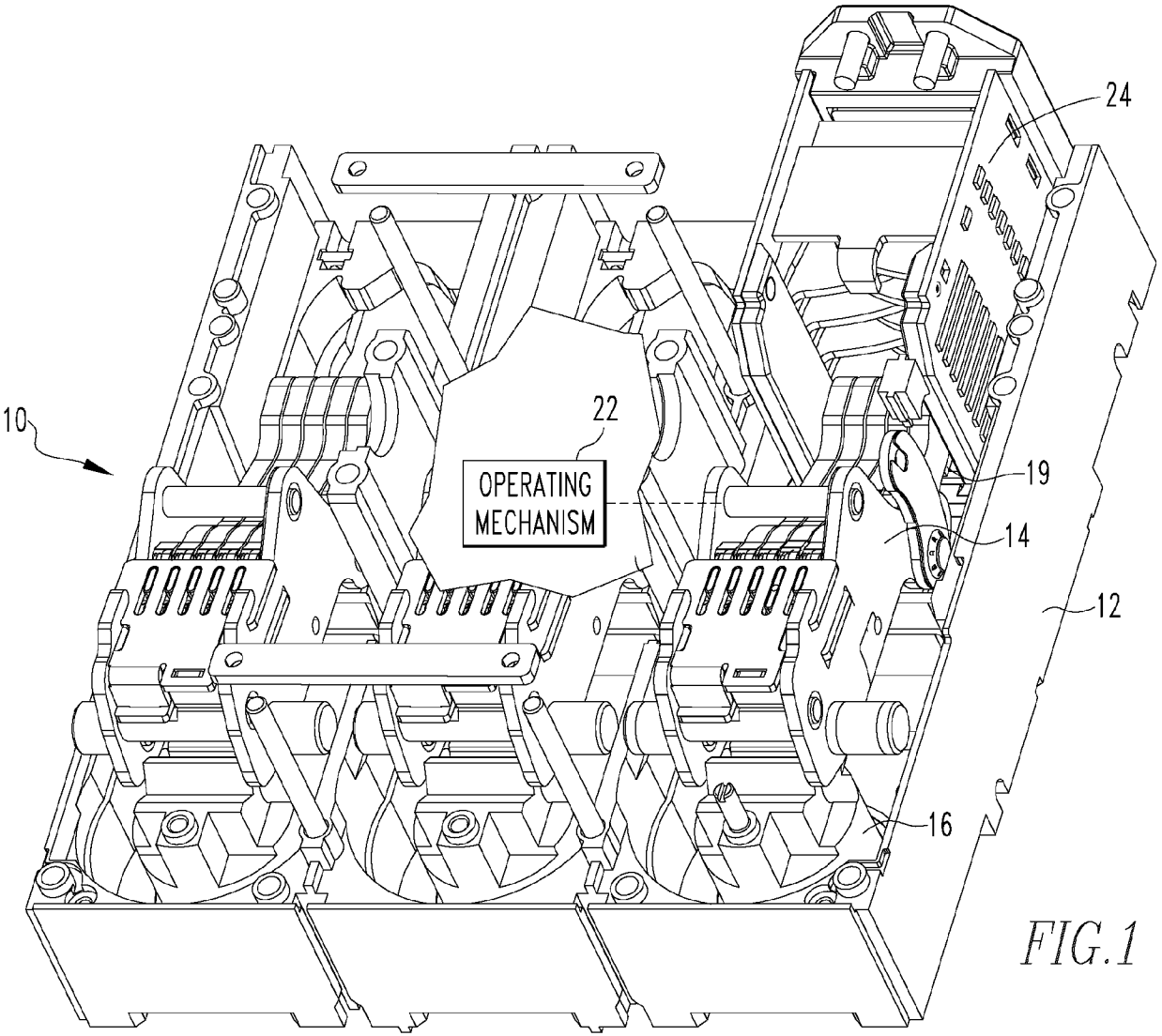
FIG. 1 is an isometric view of a circuit breaker assembly with a top housing and some internal components removed.

For purposes of illustration, embodiments of the invention will be described as applied to low-voltage circuit breakers, although it will become apparent that they could also be applied to the contact assemblies of any known or suitable electrical switching apparatus (e.g., without limitation, circuit switching devices and circuit interrupters such as circuit breakers other than low-voltage circuit breakers, network protectors, contactors, motor starters, motor controllers and other load controllers).

Directional phrases used herein, such as, for example, left, right, clockwise, counterclockwise and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
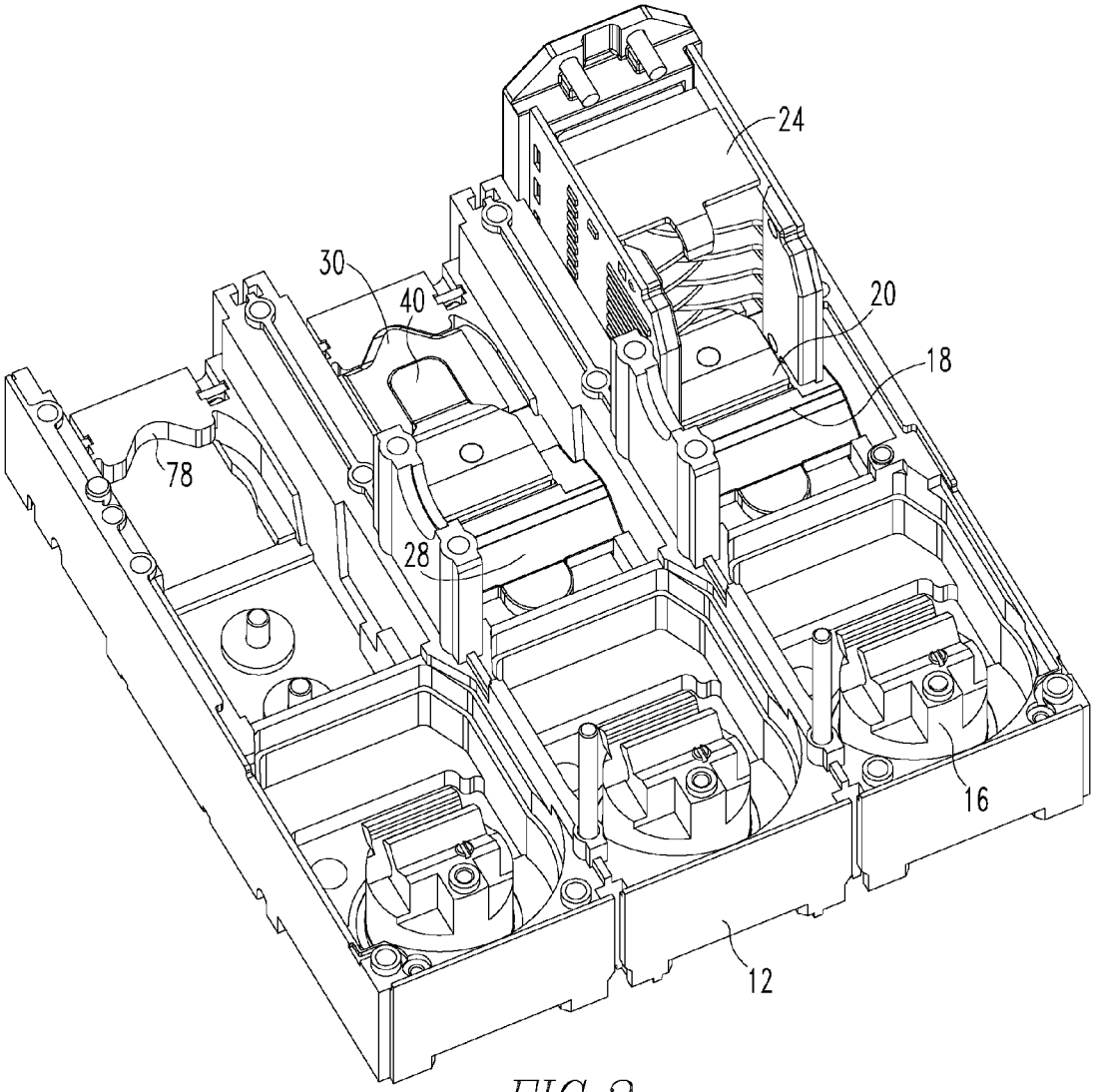
FIG. 2 is another isometric view of the circuit breaker assembly of FIG. 1 with additional internal components removed.

FIG. 1 shows a portion of an example electrical switching apparatus, such as a circuit breaker 10, including a lower housing 12, a movable contact assembly 14, a load conductor 16, and a line conductor assembly 18 (shown in FIGS. 2-6), partially enclosed by the lower housing 12. As known in the art, an upper housing (not shown) acts in cooperation with the lower housing 12 to enclose the components of the circuit breaker 10. The movable contact assembly 14 is electrically coupled to the load conductor 16 at a first end and selectively electrically coupled at the opposite end via a movable contact 19 (best shown in phantom line in FIG. 5) to a stationary contact 20 (shown in FIGS. 2-6) of the line conductor assembly 18. An operating mechanism 22 (shown in simplified form in FIG. 1) is structured to open and close the separable contacts 19,20, and actuates the movable contact assembly 14 in response to an electrical fault (e.g., without limitation, an overcurrent condition, an overload condition, an undervoltage condition, or a relatively high level short circuit or fault condition). When the breaker "trips," (i.e., the movable contact 19 of movable contact assembly 14 separates from the stationary contact 20) an arc (not shown) is generated. As best shown in FIG. 2, the circuit breaker 10 includes at least one arc chute assembly 24 disposed at or about the stationary contact 20 and the movable contact 19 (FIGS. 1 and 5) in order to attract and dissipate the arc. No special structure of arc chute is required by the present invention beyond those commonly known in the art.

FIGS. 3-6 show the example line conductor assembly 18, which includes a line conductor 26, a first insulator member 28, and a second insulator member 30. The line conductor 26 includes a first end 32, a second end 34, and a central raised portion 36 therebetween having a top surface 38. The line conductor 26 is formed from a suitable conductive material, such as, but not limited to, copper. Rigidly coupled to the top surface 38 of the raised portion 36 is a generally flat stationary contact 20, which is also formed from a suitable conductive material, preferably of greater conductivity than that of the line conductor 26. Stationary contact 20 is preferably secured to top surface 38 by brazing, resistance welding, soldering, or other equivalent or suitable technique known in the art. Also attached to the top surface 38 of the raised portion 36, adjacent stationary contact 20, is a generally flat arc runner 40, made from a suitable durable, conductive material, such as, but not limited to, nickel plated steel. Plating of the arc runner 40, while not a necessity, is preferably utilized for increasing durability of the arc runner 40 while also assisting arc travel along the arc runner 40. Preferably, arc runner 40 is rigidly attached to the top surface 38 at a first end 42 of arc runner 40 and extends in a cantilever-like manner over a portion of line conductor 26 toward the second end 34 of line conductor 26 terminating in a second end 44. Arc runner 40 is preferably rigidly attached to raised portion 36 via redundant mechanical connections. In the example embodiment shown in FIG. 4, arc runner 40 is secured to top surface 38 by both a rivet member 46 and additionally by brazing, resistance welding, soldering, or other equivalent or suitable technique.

First insulator member 28 and second insulator member 30 are preferably formed from a rigid, gassing insulator material such as, but not limited to, cellulose filled melamine formaldehyde or cellulose filled urea formaldehyde. Such gassing insulators not only provide electrical insulation but also specific gassing properties in the presence of an electrical arc, which can be utilized to provide enhanced arc motion and arc cooling. Insulator members 28 and 30 may also be formed from other useful but more limiting materials, such as, but not limited to, nylon or glass polyesters, particularly alumina trihydrate filled glass polyesters.

Figure 5:
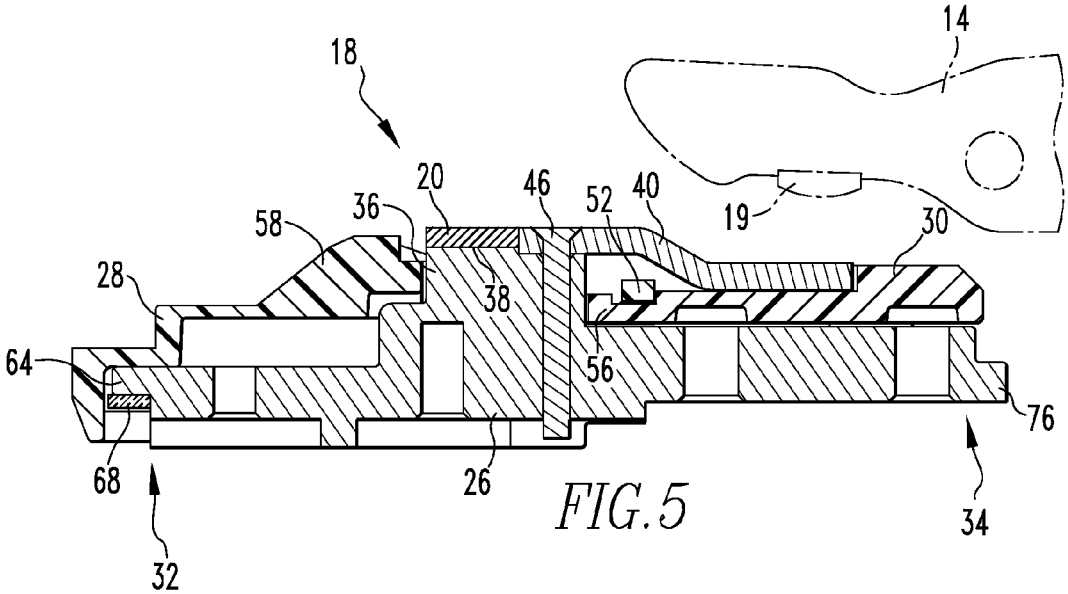
FIG. 5 is a sectional view taken along line 5-5 of FIG. 4 including in phantom line a partial side view of the movable contact assembly.
Figure 6:
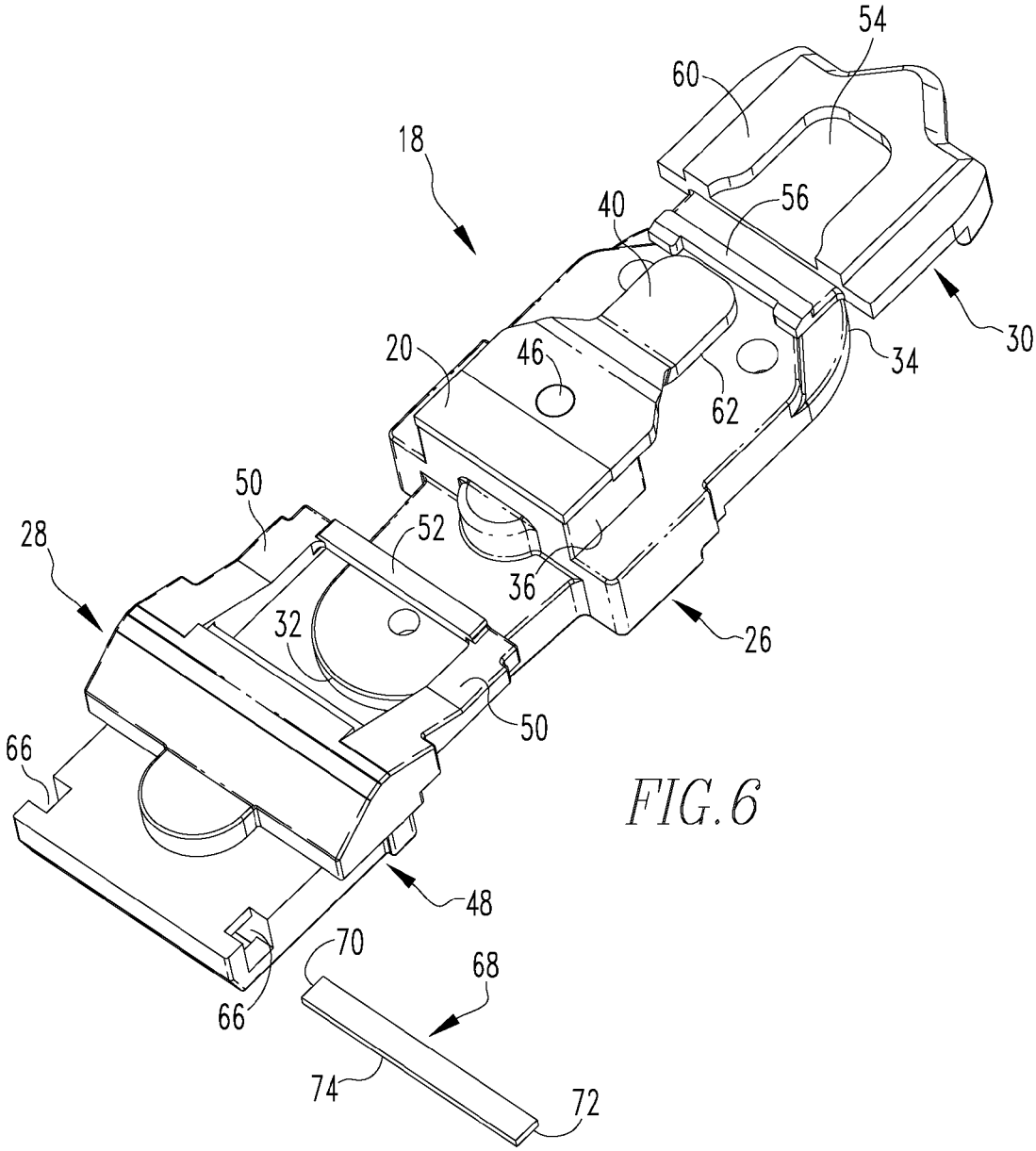
FIG. 6 is an exploded isometric view of the line conductor assembly of FIGS. 3 and 4.
Figure 7:
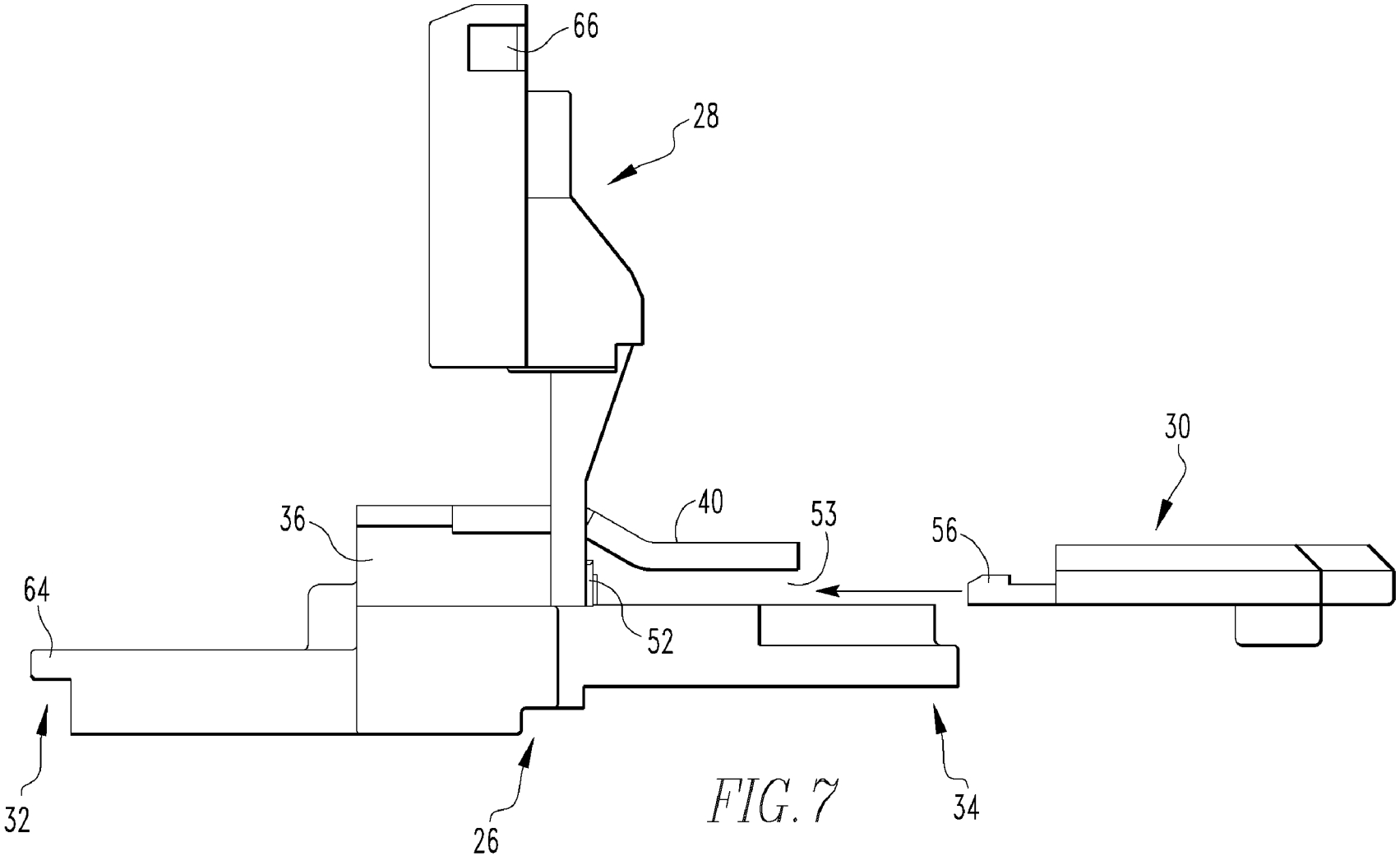
FIG. 7 is an exploded side view of the line conductor assembly of FIGS. 3 and 4.

Referring to FIG. 6, first insulator member 28 includes a main portion 48 having a pair of arm members 50 extending generally therefrom. The arm members 50 are connected at ends opposite main portion 48 by interlock structure 52. The underside (not shown) of first insulator member 28 is preferably formed to cooperatively engage the corresponding top portion of line conductor 26. As shown in FIG. 7, installation of first insulator member 28 is carried out by first sliding interlock structure 52 into the gap 53 formed between arc runner 40 and line conductor 26 while holding first insulator member 28 generally perpendicular to line conductor 26. When the interlock structure 52 reaches raised portion 36, the first insulator member 28 is then rotated downwardly (in a counterclockwise direction with regard to FIG. 7) toward the first end 32 of line conductor 26 such that first insulator member 28 lies generally parallel to, and on top of line conductor 26 (as best shown in FIG. 5).

Figure 3:
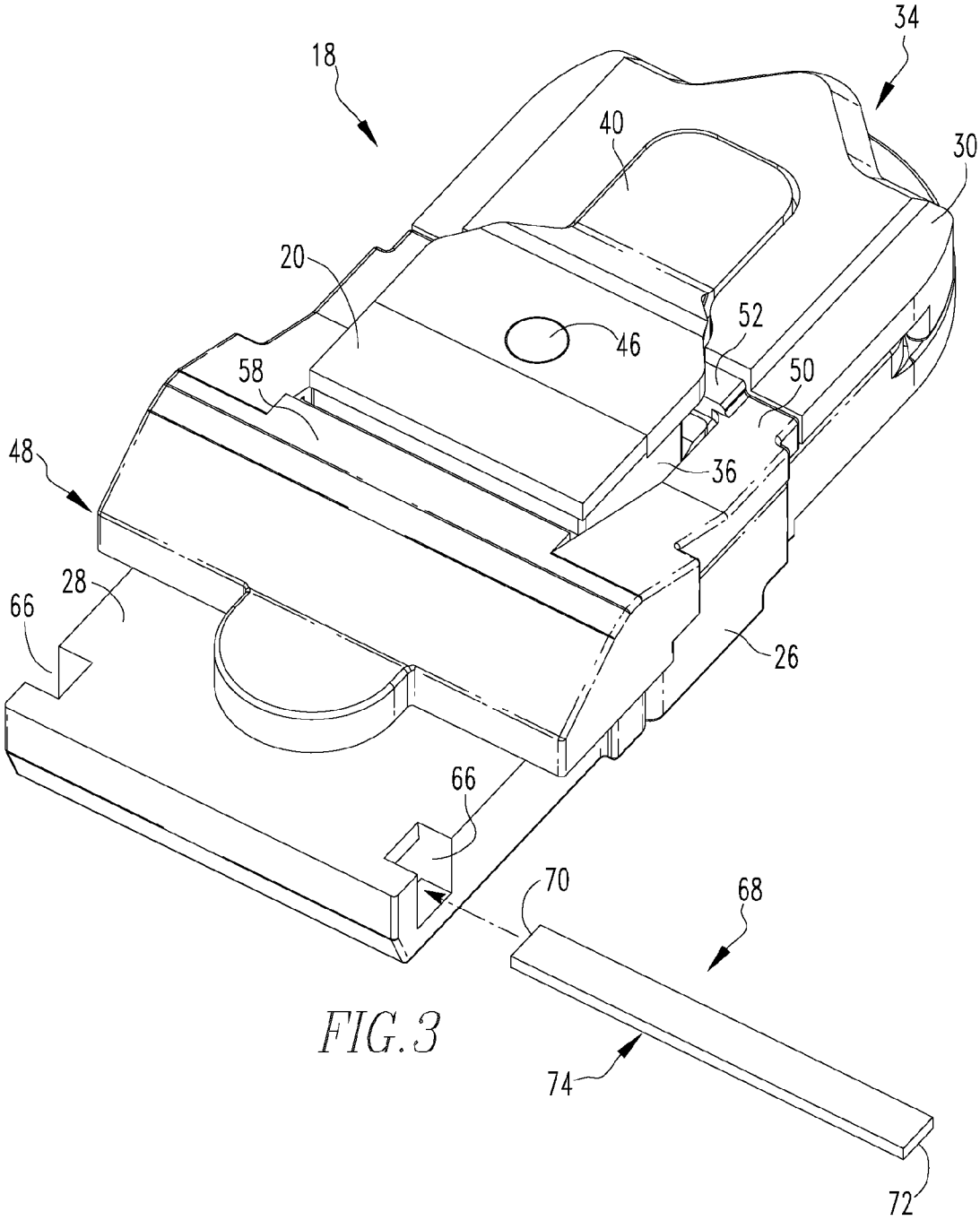
FIG. 3 is an isometric view of a line conductor assembly in accordance with embodiments of the invention.
Figure 4:
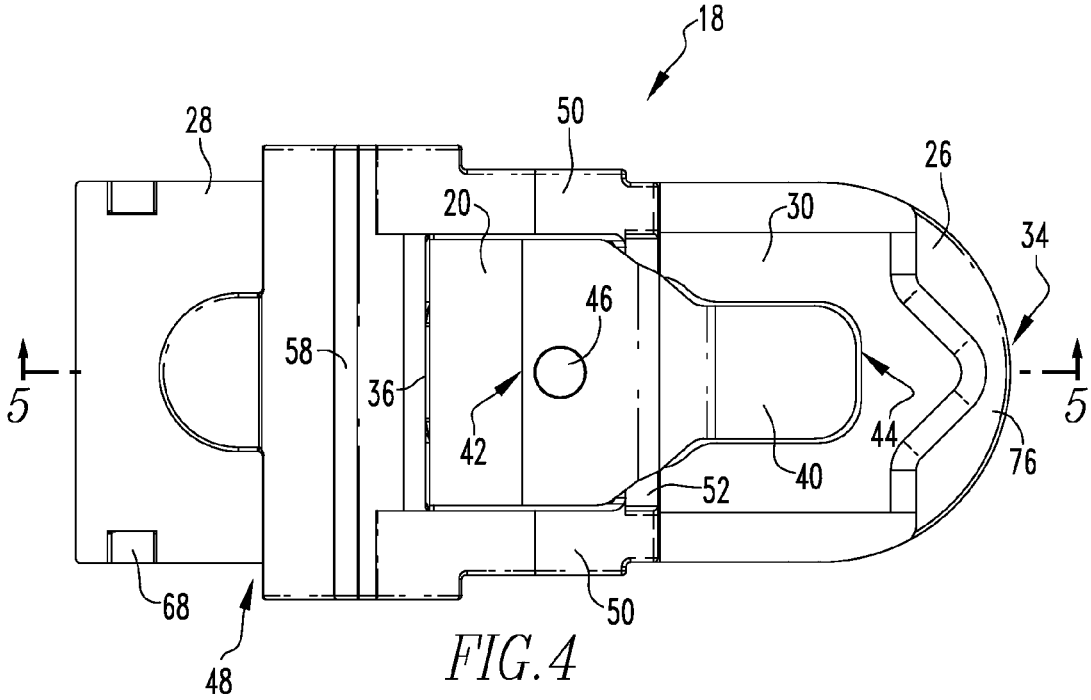
FIG. 4 is a plan view of the line conductor assembly of FIG. 3.

When installed as part of line conductor assembly 18, as best shown in FIGS. 3-5, first insulator member 28 generally covers the first end 32 (FIGS. 5-6) of line conductor 26. Additionally, as best shown in FIGS. 3 and 5, first insulator member 28 generally surrounds raised portion 36 of line conductor 26 as arm members 50 extend along opposing sides of raised portion 36 toward the second end 34 of line conductor 26 and interlock structure 52 lies on the opposing side of raised portion 36 from main portion 48. Such a structure not only provides insulation to the raised portion 36, but also aids in assembly of line conductor assembly 18 by assisting in retaining the first insulator member 28 in place until further assembly steps are taken as will be described. As best shown in FIGS. 4 and 5, the main portion 48 of first insulator member 28 preferably includes a portion 58 of increased mass situated generally adjacent stationary contact 20 in order to provide increased outgassing from the insulator material (in the presence of an arc formed on or near the stationary contact 20) in a manner which promotes movement of the arc away from the stationary contact 20 toward the arc runner 40 and associated arc chute assembly 24 (FIG. 2).

In further reference to FIG. 6, second insulator member 30 includes a generally planar portion 54 including an interlock structure 56, a raised portion 60 and an underside (not shown) preferably formed to cooperatively engage the corresponding top portion of line conductor 26. Installation of second insulator member 30 is carried out after installation of first insulator member 28 has been carried out as described above.

Referring to FIGS. 5 and 7, second insulator member 30 is installed onto line conductor 26 by first inserting interlock structure 56 into the gap 53 (FIG. 7) formed between arc runner 40 and line conductor 26 while holding second insulator member 30 generally parallel to line conductor 26, and continuing insertion until interlock structure 56 of the second insulator member 30 engages the interlock structure 52 of the first insulator member 28 (FIG. 5). It is preferable that second insulator member 30 and gap 53 be cooperatively sized such that insertion of second insulator member 30 requires overcoming a mild resistive force. Once installed, such resistive force along with the interaction of interlock structures 52, 56 act to maintain proper positioning of the first and second insulator members 28, 30 within line conductor assembly 18.

When installed in line conductor assembly 18, as best shown in FIGS. 3-5, second insulator member 30 is disposed near, and generally covers the second end 34 of line conductor 26, occupying the gap 53 (FIG. 7) formed between arc runner 40 and line conductor 26, thus serving to insulate the arc runner 40 from the portion of the line conductor 26 below. Raised portion 60, as best shown in FIG. 6, extends around a periphery 62 of arc runner 40. The structure of raised portion 60 in conjunction with the gassing material from which second insulator member 30 is formed provides cooling to the arc runner 40 while promoting arc movement away from the periphery 62 as an arc travels from the stationary contact 20 toward the arc chute assembly 24 (FIG. 2).

In a further example embodiment of the line conductor assembly 18 shown in FIGS. 3 and 6, line conductor 26 further includes a retention structure 64 (FIG. 5) extending from first end 32, and the first insulator member 28 further includes a pair of retention openings 66. An elongate retention member 68 having a first end 70, a second end 72 and a central portion 74 therebetween is positioned such that each of the first and second ends 70,72 respectively engages the first insulator member 28 at one of the pair of retention openings 66 while the central portion 74 engages retention structure 64, in a manner that helps to retain the first insulator member 28 with respect to line conductor 26. Positioning of retention member 68 is accomplished by first sliding one of the ends 70,72 into a first one of the retention openings 66 and continuing to slide until the inserted end reaches and engages the first insulating member 28 at the second one of the retention openings 66 after passing under the retention structure 64.

As best shown in FIGS. 4 and 5, the example line conductor 26 is further provided with an integral lower retention lip 76 to aid in securing the line conductor assembly 18 in lower housing 12. During installation of the line conductor assembly 18 into the lower housing 12, the lower retention lip 76 is first inserted under an upper retention lip 78 (FIG. 2) of lower housing 12. The lower retention lip 76 acts in cooperation with the upper retention lip 78 of lower housing 12 to restrict movement of the second end 34 of line conductor 26, and thus line conductor assembly 18, with respect to the lower housing 12 until further mechanical connections are made during assembly of the circuit breaker assembly 10.

It is to be appreciated that the disclosed line conductor assembly 18 does not require any tools or fasteners to assemble.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An insulator assembly for a line conductor assembly of an electrical switching apparatus, said line conductor assembly including a line conductor having a first end, a second end and a raised portion therebetween; a cantilever member rigidly coupled to said raised portion and extending over a portion of said line conductor toward the second end of said line conductor and a stationary contact rigidly coupled to said raised portion and electrically connected to said cantilever member, said insulator assembly comprising:

a first insulator member structured to be generally disposed near the first end of said line conductor; and a second insulator member structured to be generally disposed between said line conductor and said cantilever member near the second end of said line conductor, wherein said second insulator member comprises a number of interlock structures; and wherein said first insulator member comprises a number of arm members structured to extend generally along a portion of said raised portion toward said second insulator member, said number of arm members terminating in a number of interlock structures which are structured to fasteningly engage the number of interlock structures of said second insulating member.

2. The insulator assembly of claim 1, wherein said first insulating member comprises an elongated retention member having a first end, a second end, and a central portion therebetween; and a number of retention openings structured to align with a retention structure extending from the first end of said line conductor, the first and second ends of said elongated retention member engaging said first insulating member at said retention openings and the central portion of said retention member being structured to engage the retention structure of said line conductor.

3. A line conductor assembly for an electrical switching apparatus including a housing having housed therein an arc chute assembly and a load conductor electrically connected to a movable contact assembly, said line conductor assembly comprising:

a line conductor including a first end, a second end and a raised portion therebetween;

a stationary contact rigidly coupled to the raised portion of said line conductor, said stationary contact structured to be selectively electrically connected to said movable contact assembly;

a cantilever member including a first end electrically connected to said stationary contact and rigidly coupled to the raised portion of said line conductor, said cantilever member extending over a portion of said line conductor toward the second end of said line conductor and terminating at a second end, the second end of said cantilever member structured to be positioned in close proximity to said arc chute assembly; and an insulator assembly comprising:

a first insulator member generally disposed near the first end of said line conductor, and a second insulator member generally disposed between said line conductor and said cantilever member near the second end of said line conductor, wherein said second insulator member comprises a number of interlock structures; and wherein said first insulator member comprises a number of arm members structured to extend generally along a portion of said raised portion toward said second insulator member, said number of arm members terminating in a number of interlock structures which are structured to fasteningly engage the number of interlock structures of said second insulating member.

4. The line conductor assembly of claim 3, wherein said line conductor comprises a retention structure extending from said first end; and wherein said first insulating member comprises an elongated retention member having a first end, a second end, and a central portion therebetween; and a number of retention openings aligned with the retention structure extending from the first end of said line conductor, the first and second ends of said elongated retention member engaging said first insulating member at said retention openings and the central portion of said retention member engaging the retention structure of said line conductor.

5. An electrical switching apparatus comprising:

a housing;

a load conductor;

a line conductor assembly comprising:

a line conductor including a first end, a second end and a raised portion therebetween, a stationary contact rigidly coupled to the raised portion of said line conductor, a cantilever member including a first end electrically connected to said stationary contact and rigidly coupled to the raised portion of said line conductor, said cantilever member extending over a portion of said line conductor toward the second end of said line conductor and terminating at a second end of said cantilever member, and an insulator assembly comprising:

a first insulator member generally disposed near the first end of said line conductor, and a second insulator member generally disposed between said line conductor and said cantilever member near the second end of said line conductor;

a movable contact assembly electrically connected to said load conductor and selectively electrically connected to the stationary contact of said line conductor assembly; and an arc chute assembly positioned in close proximity to the second end of the cantilever member of said line conductor assembly, wherein said second insulator member comprises a number of interlock structures; and wherein said first insulator member comprises a number of arm members which extend generally along a portion of said raised portion toward said second insulator member, said number of arm members terminating in a number of interlock structures which are structured to fasteningly engage the number of interlock structures of said second insulating member.

6. The electrical switching apparatus of claim 5, wherein said line conductor comprises a retention structure extending from the first end of said line conductor; and wherein said first insulating member comprises an elongated retention member having a first end, a second end, and a central portion therebetween; and a number of retention openings aligned with the retention structure extending from the first end of said line conductor, the first and second ends of said elongated retention member engaging said first insulating member at said retention openings and the central portion of said retention member engaging the retention structure of said line conductor.

* * * * *